United States Patent [19]

Shibano

[11] Patent Number: 4,660,920

[45] Date of Patent: Apr. 28, 1987

[54] PRINTED CIRCUIT BOARD CONNECTOR

[75] Inventor: Yasuji Shibano, Izumisano, Japan

[73] Assignee: Hosiden Electronics Co., Ltd., Japan

[21] Appl. No.: 840,848

[22] Filed: Mar. 18, 1986

[30] Foreign Application Priority Data

Sep. 2, 1985 [JP] Japan ..... 60-134919[U]

[51] Int. Cl.[4] ..... H01R 23/68

[52] U.S. Cl. ..... 339/176 MP; 339/205

[58] Field of Search ..... 339/17 L, 17 LC, 17 LM, 339/17 M, 154 R, 154 A, 156 R, 176 MP, 205, 217 S

[56] References Cited

U.S. PATENT DOCUMENTS

| | | | |
|---|---|---|---|
| 3,601,751 | 8/1971 | Pauza | 339/217 S |
| 4,400,049 | 8/1983 | Schuck | 339/205 |
| 4,505,528 | 3/1985 | Reimer | 339/205 |

*Primary Examiner*—Neil Abrams

*Attorney, Agent, or Firm*—Jones, Tullar & Cooper

[57] ABSTRACT

The disclosure relates to a connector for connecting at least two printed circuit boards without forming a soldered connection to any of the boards. The connector includes a housing having a front face and a rear face, each face being formed with an elongated aperture for receiving therein one edge of a corresponding printed circuit board. A plurality of contact guide channels are formed in the housing extending in parallel spaced relation between the front and rear faces and opening in both faces on opposite sides of the elongated board receiving apertures. Each contact has curved, circuit engaging fingers adjacent to the opposite ends thereof. Each channel is in communication with the elongated apertures to allow the contact's fingers to extend into the apertures thus making electrical contact with circuitry on the printed circuit boards. Each contact may be assembled into a corresponding channel from one housing face in a manner to result in a proper preloading of the contact.

20 Claims, 14 Drawing Figures

PRINTED CIRCUIT BOARD CONNECTOR

BACKGROUND OF THE INVENTION

The present invention relates to the field of connectors and, more particularly, to an improved edge board connector for releasably connecting a plurality of printed circuit boards.

It is common in the manufacture of electronic devices to provide an interface between circuits on a plurality of printed circuit boards, which may be in the form of ribbon cords or edge board connectors. As exemplified in FIG. 1, such edge board connectors may comprise a housing 1 made of a suitable synthetic resin material and a plurality of preloaded electrical contacts 2, 3 arranged in opposed pairs within the housing. The housing 1 may have an elongated aperture in its front face 4 for receiving the leading edge of a printed circuit board 5. The electrical contacts may include metallization fingers adapted to make electrical contact with circuitry on the board when it is assembled into place. The electrical contacts 2, 3 may have bare lead ends extending from a rear face 7 of the housing and such ends may be soldered to individual conductors on another printed circuit board 8. However, such soldered connection would sometimes become faulty during the use of the connector and cannot provide for easy disconnection thereof from the board if desired. Further, there is always the problem of potential damage to the bare lead ends due to inadvertent handling.

It is desirable therefore to provide a connector wherein two printed circuit boards can be inserted for electrical connection therebetween without the necessity of forming a soldered connection to any of the boards. To accomplish this, it is necessary to provide the connector with two board receiving apertures in the front and rear faces thereof. However, such construction would make it extremely difficult to assemble electrical contacts into place within the housing wherein the resiliant contacts are properly preloaded. This requirement for a proper preloading prevents the development of connectors which can releasably connect two printed circuit boards.

SUMMARY OF THE INVENTION

It is therefore an object of the present invention to provide a new and improved connector assembly wherein two printed circuit boards may be releasably connected to each other without requiring a soldering operation.

It is a further object of the present invention to provide a new and improved connector assembly wherein the leading edges of two printed circuit boards may be inserted into corresponding elongated apertures formed in the front and rear faces of the connector housing.

It is still a further object of the present invention to provide a new and improved connector assembly which includes a plurality of contact guide channels extending in parallel spaced relation on opposite sides of the board receiving apertures between the front and rear faces of the housing and wherein each contact may be assembled into a corresponding guide channel from one of the housing faces without leaving any bare lead end externally of the housing.

It is still another object of the present invention to provide a new and improved connector assembly wherein the contacts may be assembled into the housing in a manner to result in a proper preloading of the contacts thus ensuring a good and reliable electrical contact with circuitry on printed circuit boards.

It is still a further object of the present invention to provide a new and improved connector assembly wherein the elongated board receiving apertures are separated from each other by a partition formed in the housing and wherein the leading edge of each printed circuit board is adapted to abut against the partition when it is inserted into position.

It is still a further object of the present invention to provide a new and improved connector assembly wherein each contact may be inserted into the housing as guided by shoulders formed in a corresponding contact guide channel, thus permitting an easy contact assembly operation.

It is still a further object of the present invention to provide a new and improved connector assembly wherein the height of the shoulders in each contact guide channel increases gradually from the front and rear faces of the housing toward the intermediate portion of the channel so that the contact may be inserted into the channel without abutting against a partition separating the board receiving apertures.

It is still a further object of the present invention to provide a new and improved connector assembly wherein in assembly each contact is snapped into position through the engagement of a raised stop member formed in the contact with a corresponding recess formed in the intermediate portion of the contact guide channel and also is prevented from slipping out of position by the engagement of a lance formed in the contact closer to its forward-most end than the raised stop member with a corresponding triangular recess formed in the guide channel's intermediate portion, thus enabling a quick and automated assembly of electrical-contacts into position.

It is still a further object of the present invention to provide a new and improved connector assembly wherein each printed circuit board is held in position within a corresponding aperture by a plurality of pairs of preloaded contacts sandwiching the board, thus ensuring a good electrical contact with circuitry on the board.

It is still a further object of the present invention to provide a new and improved connector assembly wherein each contact finger is curved and has an elongated, longitudinally extending hole which permits contact metallization portions provided on both sides of the hole to make a good electrical contact with conductors on a printed circuit board.

It is still a further object of the present invention to provide a new and improved connector assembly wherein each contact finger is metallized by plating it with gold to ensure a good electrical contact with circuitry on a printed circuit board.

The objects stated above and other related objects in this invention are accomplished by the provision of an edge board connector for connecting at least a first and a second printed circuit board, comprising a housing of electrically insulating material having a front face and a rear face, a first elongated aperture in the front face adapted to receive therein one edge of a first printed circuit board, a second elongated aperture in the rear face adapted to receive therein one edge of a second printed circuit board, a plurality of channels in the housing extending between the front and rear faces thereof, the channels opening in the front and rear faces on opposite sides of the first and second elongated apertures, respectively, and being in communication therewith, and a plurality of contacts each being positioned within at least one of the channels, each contact having circuit engaging means adjacent to the opposite ends thereof for engaging circuitry on the first and second printed circuit boards, each channel being configured to permit an easy assembly of a corresponding contact into the channel from one of the first and second faces in a manner to result in a proper preloading of the contact, the circuit engaging means for each contact extending into the first and second elongated apertures so as to make electrical contact with circuitry on the first and second printed circuit boards when inserted into place within the first and second elongated apertures, respectively.

DESCRIPTION OF THE PREFERRED EMBODIMENTS

Figure 1:
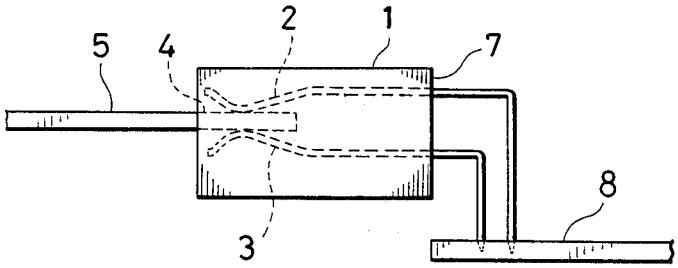
FIG. 1 PRIOR ART
FIG. 1 is a schematic side elevation of a conventional edge board connector having its bare lead ends soldered to one of two printed circuit boards connected by the connector.
Figure 2:
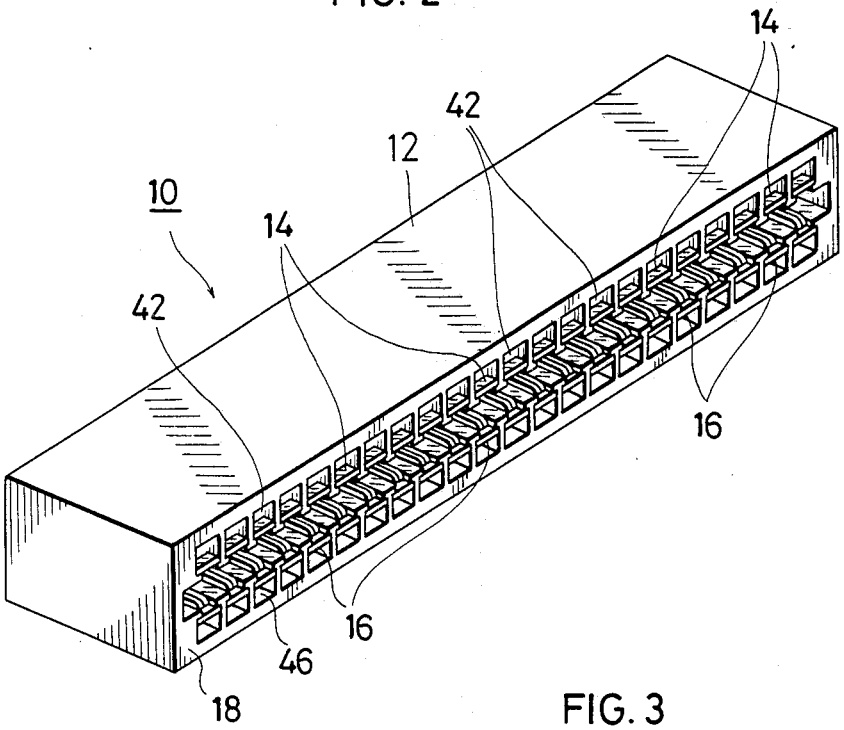
FIG. 2 is a perspective view showing an edge board connector in accordance with the present invention.
Figure 3:
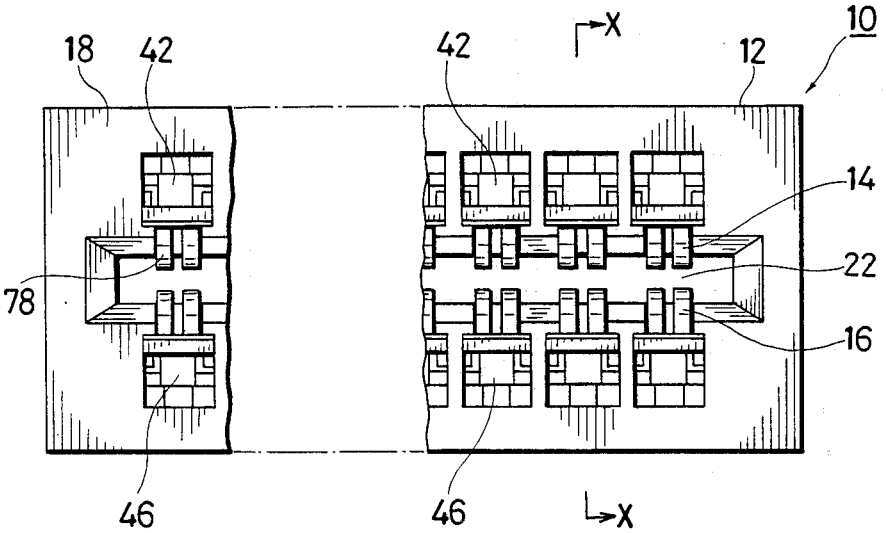
FIG. 3 is a fragmentary, frontal view of the connector of FIG. 2.

Referring now to the drawings, wherein like reference numerals refer to like elements in the several figures, there is illustrated in FIG. 2 an edge board connector 10 in accordance with a preferred embodiment of the present invention. The connector 10 comprises an elongated housing 12 of a suitable insulating material, such as a synthetic resin, and a first and a second plurality of electrical contacts 14, 16 arranged in opposed pairs within the housing 12. Each contact extends laterally of the housing. The housing 12 has a front face 18 and a rear face 20. As best seen in FIG. 3, the front face 18 has an elongated aperture 22 formed therein for receiving the leading edge of one printed circuit board (not shown). As best seen in the left-hand portion of FIG. 4, the rear face 20 is likewise provided with a similar aperture 24 for receiving therein one edge of another printed circuit board (not shown) which is to be connected to the one printed circuit board by means of the connector 10. The apertures 22 and 24 are respectively configured and dimensioned to match the specific width and thickness of the associated printed circuit boards and are separated from each other by a partition 26 provided in the center of the housing 12. The walls surrounding each aperture 22, 24 are beveled at 28 and 30 to facilitate insertion of its associated printed circuit board.

Figure 4:
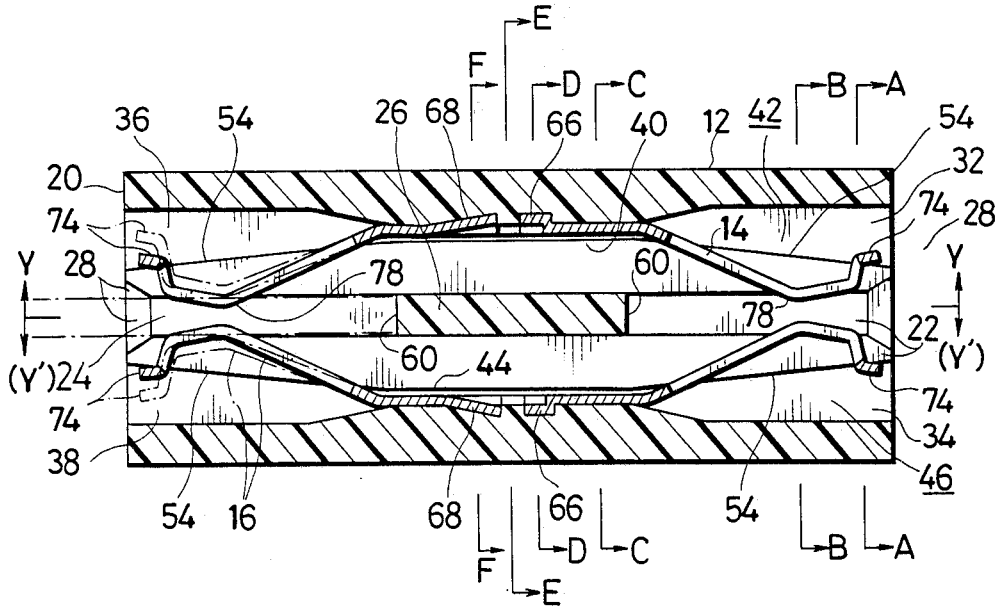
FIG. 4 is a section view taken along line X—X of FIG. 3.

With continued reference to FIG. 4, the front face 18 of the housing 12 has a first and a second plurality of passageways 32 and 34 formed on the upper and lower sides of the aperture 22, respectively. In a like manner, the rear face 20 has a third and a fourth plurality of passageways 36 and 38 on the upper and lower sides of the aperture 24, respectively, which correspond to the first and second plurality of passageways 32 and 34, respectively. Each passageway 32 is aligned with a corresponding passageway 36, while each passageway 34 is aligned with a corresponding passageway 38. The corresponding, opposed passageways 32 and 36 are in communication with each other through an intermediate portion 40, forming together a contact guide channel 42 for contact 14. In a like manner, the corresponding passageways 34 and 38 are in communication with each other through an intermediate portion 44, comprising a contact guide channel 46 for contact 16.

As best seen in FIGS. 5A to 5F, each contact guide channel 42, 46 is separated from its adjacent ones by partition walls 48 throughout its length. Each partition wall 48 comprises an enlarged or flange portion 50 formed at the inner end thereof and a thin or constricted portion 52 extending between the enlarged portion 50 and the outer wall of housing 12. The enlarged portion 50 forms shoulder means 54 together with the associated thin or constricted wall portion 52. Each contact guide channel 42, 46 is in communication with both apertures 22 and 24 by way of elongated openings 56 and 58 defined between the enlarged portions 50 of its associated partition walls 48. As best seen from comparison of FIGS. 5A, 5B and 5C, the openings 56 and 58 extend from the beveled entrances of their associated guide channels 42, 46 and end with their corresponding walls 60 of the partition 26.

Figures 5A, 5B, 5C, 5D:
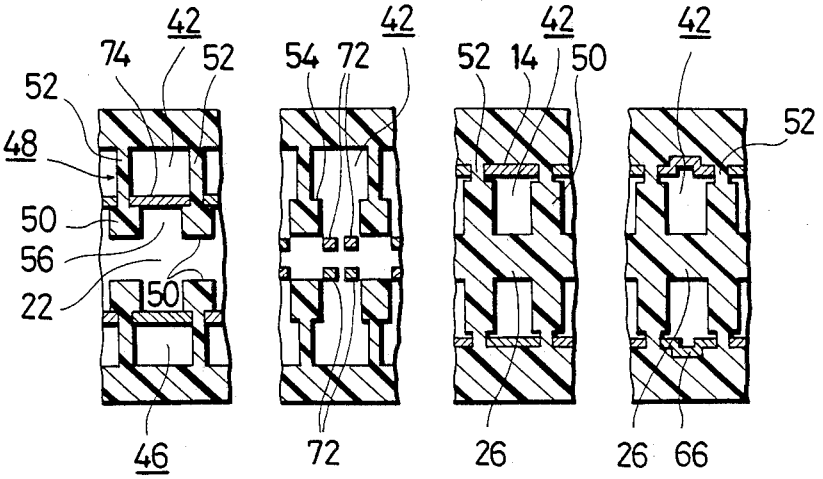
FIGS. 5A through 5F are section views taken along lines A—A, B—B, C—C, D—D, E—E, and F—F, respectively, of FIG. 4.
Figure 5E:
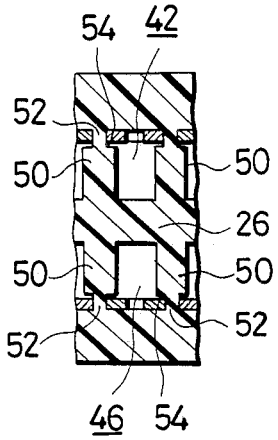
Figure 5F:
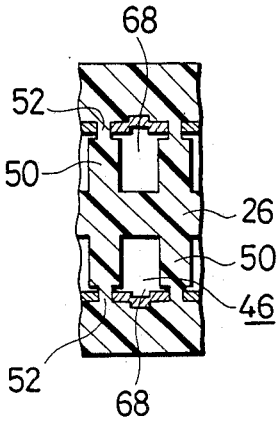

As best seen in FIGS. 5A to 5F, each contact guide channel 42, 46 is configured and dimensioned such that a corresponding contact can snugly bear on and span both shoulders 54 in a manner not to slip into a space, or elongated opening, defined between the enlarged portions 50 of the partition walls 48. The height of the shoulders 54 relative to the innermost end of the enlarged portions 50 increases gradually from the front and rear faces toward the intermediate portion of each channel, as is best seen in FIG. 3. The shoulders 54 are at the highest level throughout the intermediate portion of the channel adjacent to the partition 26, as is best seen in FIGS. 5C and 5D. It is also to be observed that the outer wall of each contact guide channel 42, 46 is at the highest level relative to the innermost end of the enlarged portions 50 of its associated partition walls 48 in the entrance zone of the contact guide channel so as to facilitate insertion of a corresponding electrical contact during assembly as well as to permit resilient contact fingers to flex during insertion of printed circuit boards. Each contact guide channel gradually decreases its height and is at the lowest level in the intermediate portion thereof, forming a narrow, horizontal passageway together with the raised shoulders 54. The outer wall of the intermediate portion 40, 44 of each guide channel 42, 46 is formed with a rectangular recess 62 of uniform depth and a generally triangular recess 64 of varying depth, as is best seen in FIG. 8. The rectangular recess 62 is adapted to receive therein a raised stop member 66 formed in the contact when it is properly located in place within the housing 12. The generally rectangular recess 64 serves to prevent the electrical contact that has been properly located from slipping out of position.

Figure 6:
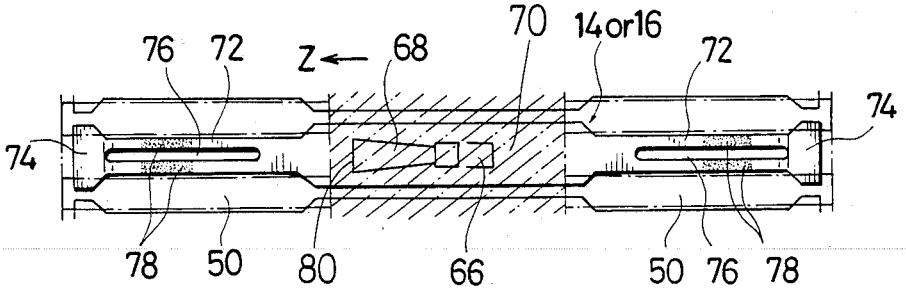
FIG. 6 is a section view taken along line Y—Y or Y'—Y' of FIG. 4, showing an electrical contact used in the connector of FIG. 1.

Turning now to FIG. 6, there is shown an embodiment of the electrical contacts 14, 16 employed in the connector 10 of the present invention. Each contact is made of a suitable electrically conductive material and is formed from a one-piece blank. It is formed in symmetry both longitudinally and laterally thereof except for the disposition of the raised stop member 66 and a lance 68 formed in the intermediate portion 70 of the contact. A resilient finger 72 formed at each contact end has a flange, or enlarged portion 74, the width of which is slightly less than that of a corresponding contact guide channel, that is, the spacing between the constricted wall portions 52. This will permit a smooth insertion of the contact into the guide channel. The lance 68 is formed closer to the leading or forwardmost end of the contact than the raised stop member 66, providing that the contact is inserted into the guide channel in the direction as indicated by arrow Z. The lance 68 is also a raised member having its base 80 continuous with the intermediate portion of the contact. Each finger 72 has an elongated opening 76 and is curved to provide a built-in resiliency. It also includes a metallization contact portion 78 provided generally in the middle of each finger, which faces inwards to make an electrical contact with circuitry on a printed circuit board. The contact portion 78 may be metallized by plating it with gold to minimize current loss.

When assembled into the housing 12, the resilient contact fingers 72 are biased toward the housing outer walls because of their flanges 74 bearing on the shoulders 54, as shown in FIG. 4. In this position, the metallization contact portions 78 extend into the board receiving apertures 22 or 24. When a printed circuit board is inserted into the aperture, the fingers 72 are moved further toward the housing outer walls into the positions as indicated by phantom lines, resulting in a corresponding increase in the fingers' biasing force. Thus, it will be appreciated that the built-in resiliency in the fingers 72 ensures a good electrical contact with circuitry on the printed circuit board.

Figure 7:
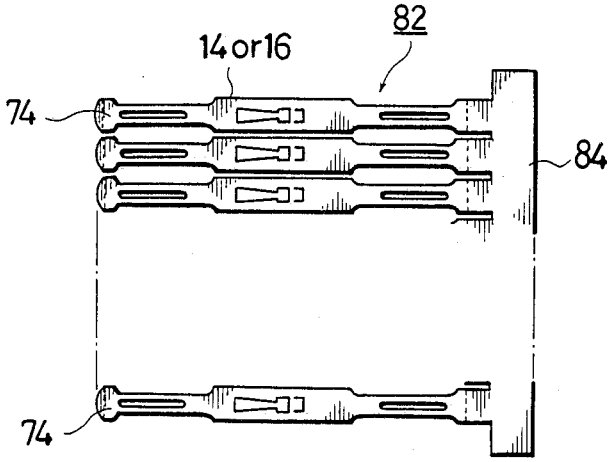
FIG. 7 is a plan view of a sheet metal progression showing the manner of manufacturing electrical contacts for the connector.

With reference to FIG. 7, the electrical contacts 14, 16 are manufactured by first producing a stamped continuous strip 82 comprising a carrier strip 84 having a plurality of contact blanks 14, 16 extending therefrom transversely at periodic intervals. The number of contact blanks 14, 16 may be equal to that of the contact guide channels 42, 46 in the housing 12. Each contact blank 14, 16 has a round flange portion 74 to prevent it from causing damage to the connector housing during assembly. During the initial phase of their assembly, the contact blanks 14, 16 are not severed from the carrier strip 84. All the contact blanks having an integral carrier strip 84 are inserted into their corresponding guide channels 42, 46 at a time.

Figure 8A:
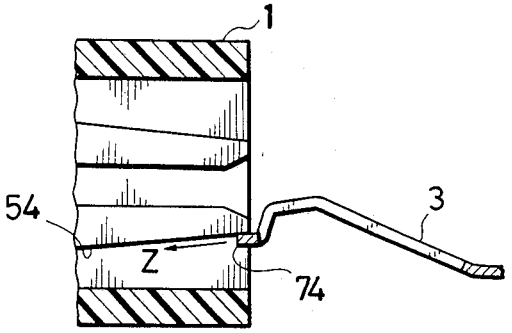
FIGS. 8A and 8B are views similar to FIG. 4, showing the manner of assembling an electrical contact into the connector housing.
Figure 8B:
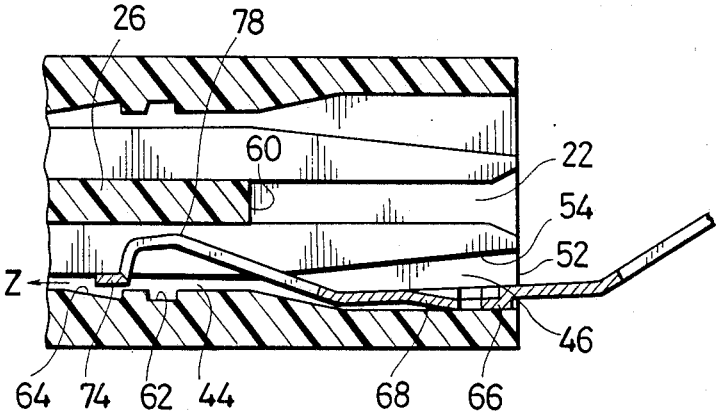

Referring now to FIGS. 8A and 8B which show the manner of assembling one of the contact blanks into the housing, it is inserted into a corresponding guide channel by first placing the flange portion 74 on the shoulders 54 and then sliding it thereon in the direction indicated by arrow Z. Since constricted wall portions 52 of the lower guide channel 46 are tapered toward the intermediate portion 44 as viewed in FIG. 8B, the metallization contact portion 78 does not abut against the wall 60 of the partition 26 as the flange portion 74 moves into the intermediate portion 44 of the guide channel 46. As can be seen, this arrangement permits a smooth insertion of the contact blanks into their corresponding guide channels without interference therefrom. Further insertion of this contact blank as guided by the shoulders 54 brings the lance 68 and the raised stop member 66 into their respective locked positions in engagement with the triangular and rectangular recesses 64 and 62, respectively. When this occurs, it is seen that the insertion of the contact blank is completed resulting in the fingers 72 being preloaded or biased in the positions shown by solid lines in FIG. 4. The carrier strip 84 is then severed from the contact blanks, and thereafter the tip of the flange portion 74 of each contact finger 72 is cut away to provide a straight edge extending perpendicular to the length of the contact.

Numerous features and advantages of the invention have been set forth in the foregoing description, together with details of structure and function of the invention. The disclosure, however, is illustrative only, and changes may be made in detail without deviating from the true scope of the invention. For example, it would be possible to modify the contacts to have metallization portions of different shape or to provide each contact with modified forms of the raised stop member 66 and lance 68. It should also be noted that while the subject connector includes electrical contacts arranged in opposed pairs to retain the board's leading edge therebetween, it is possible to modify the connector to have electrical contacts on only one side of the board receiving aperture so that the board is urged against the ceiling or bottom of the aperture by the action of preloaded contacts.

What is claimed is:

1. An edge board connector for connecting at least a first and a second printed circuit board, comprising a housing of electrically insulating material having a front face and a rear face, a first elongated aperture in the front face adapted to receive therein one edge of a first printed circuit board, a second elongated aperture in the rear face adapted to receive therein one edge of a second printed circuit board, a plurality of channels in the housing extending between the front and rear faces thereof, the channels opening in the front and rear faces on opposite sides of the first and second elongated apertures, respectively, and being in communication therewith, and a plurality of contacts each being positioned within at least one of the channels, each contact having circuit engaging means adjacent to the opposite ends thereof for engaging circuitry on the first and second printed circuit boards, each channel being configured to permit an easy assembly of a corresponding contact into the channel from one of the first and second faces in a manner to result in a proper preloading of the contact, the circuit engaging means for each contact extending into the first and second elongated apertures so as to make electrical contact with circuitry on the first and second printed circuit boards when inserted into place within the first and second elongated apertures, respectively, wherein:

the plurality of channels are arranged in parallel spaced relation on opposite sides of the first and second elongated apertures with a partition wall being formed between each two adjacent channels;

each contact has flanges in the opposite ends thereof and each partition wall between two adjacent channels has an enlarged portion in its inner end and a constricted portion extending between the enlarged portion and the outer walls of the two adjacent channels, each enlarged portion forming shoulder means on both sides of the partition wall together with the constricted portion thereof; and each contact may be assembled into a corresponding channel by sliding the flanges on the shoulder means in the channel.

2. An edge board connector as set forth in claim 1 wherein the spacing between each two adjacent constricted portions on both sides of a corresponding channel is set to snugly receive a contact on the shoulders associated with the channel so as to enable a smooth insertion of the contact into the channel.

3. An edge board connector as set forth in claim 2 wherein the height of the constricted portion of each partition wall decreases gradually from the front and rear faces of the housing toward the intermediate portion of its associated channel.

4. An edge board connector as set forth in claim 3 wherein the height of the shoulders relative to the innermost ends of the enlarged portions of their associated partition walls increases gradually from the front and rear faces of the housing toward the intermediate portion of its associated channel.

5. An edge board connector as set forth in claim 3 wherein the height of the outer wall of each channel relative to the innermost ends of the enlarged portions of its associated partition walls decreases gradually from the front and rear faces of the housing toward the intermediate portion of the channel.

6. An edge board connector as set forth in claim 2 wherein each contact has a raised stop member and a lance provided in the intermediate portion thereof and wherein each channel includes a first and a second recess formed in the intermediate portion thereof to receive therein the raised stop member and the lance of the contact, respectively.

7. An edge board connector as set forth in claim 2 wherein each circuit engaging means of the contact comprises a metallization finger which is curved to provide a built-in-resiliency and also includes an elongated opening extending longitudinally thereof.

8. An edge board connector as set forth in claim 7 wherein the fingers of each contact are metallized by plating them with gold.

9. An edge board connector as set forth in claim 4 wherein the first and second apertures are separated from each other by a partition provided in the housing and wherein each contact may be assembled into a corresponding channel from one of the front and rear faces without abutting against the partition.

10. An edge board connector as set forth in claim 1 wherein the plurality of contacts may be manufactured by first producing a stamped continuous strip comprising a carrier strip having a plurality of contact blanks extending therefrom transversely at periodic intervals and then severing the contact blanks from the carrier strip after the completion of insertion of the contact blanks into their corresponding channels.

11. An edge board connector for connecting at least a first and a second printed circuit board, comprising a housing of electrically insulating material having a front face and a rear face, a first elongated aperture in the front face adapted to receive therein one edge of a first printed circuit board, a second elongated aperture in the rear face adapted to receive therein one edge of a second printed circuit board, a plurality of channels in the housing extending between the front and rear faces thereof, the channels opening in the front and rear faces on one side of the first and second elongated apertures, respectively, and being in communication therewith, a plurality of contacts each being positioned within at least one of the channels, each contact having circuit engaging means adjacent to the opposite ends thereof for engaging circuitry on the first and second printed circuit boards, each channel being configured to permit an easy assembly of a corresponding contact into the channel from one of the front and rear faces in a manner to result in a proper preloading of the contact, the circuit engaging means for each contact extending into the first and second elongated apertures so as to make electrical contact with circuitry on the first and second printed circuit boards when inserted into place within the first and second elongated apertures, respectively, wherein:

the plurality of contacts are arranged in parallel spaced relation with a partition wall being formed between each two adjacent channels; each contact has flanges in the opposite ends thereof and each partition wall between two adjacent channels has an enlarged portion in its inner end and a constricted portion extending between the enlarged portion and the outer walls of the two adjacent channels, each enlarged portion forming shoulder means on both sides of the partition wall together with the constricted portion thereof; and each contact may be assembled into a corresponding channel by sliding the flanges on the shoulder means in the channel.

12. An edge board connector as set forth in claim 11 wherein the spacing between each two adjacent constricted portions on both sides of a corresponding channel is set to snugly receive a contact on the shoulders associated with the channel so as to enable a smooth insertion of the contact into the channel.

13. An edge board connector as set forth in claim 12 wherein the height of the constricted portion of each partition wall decreases gradually from the front and rear faces of the housing toward the intermediate portion of its associated channel.

14. An edge board connector as set forth in claim 13 wherein the height of the shoulders relative to the innermost ends of the enlarged portions of their associated partition walls increases gradually from the front and rear faces of the housing toward the intermediate portion of its associated channel.

15. An edge board connector as set forth in claim 13 wherein the height of the outer wall of each channel relative to the innermost ends of the enlarged portions of its associated partition walls decreases gradually from the front and rear faces of the housing toward the intermediate portion of the channel.

16. An edge board connector as set forth in claim 12 wherein each contact has a raised stop member and a lance provided in the intermediate portion thereof and wherein each channel includes a first and a second recess formed in the intermediate portion thereof to receive therein the raised stop member and the lance of the contact, respectively.

17. An edge board connector as set forth in claim 12 wherein each circuit engaging means of the contact comprises a metallization finger which is curved to provide a built-in-resiliency and also includes an elongated opening extending longitudinally thereof.

18. An edge board connector as set forth in claim 17 wherein the fingers of each contact are metallized by plating them with gold.

19. An edge board connector as set forth in claim 14 wherein the first and second apertures are separated from each other by a partition provided in the housing and wherein each contact may be assembled into a corresponding channel from one of the front and rear faces without abutting against the partition.

20. An edge board connector as set forth in claim 11 wherein the plurality of contacts may be manufactured by first producing a staped continuous strip comprising a carrier strip having a plurality of contact blanks extending therefrom transversely at periodic intervals and then severing the contact blanks from the carrier strip after the completion of insertion of the contact blanks into their corresponding channels.

* * * * *

UNITED STATES PATENT AND TRADEMARK OFFICE

CERTIFICATE OF CORRECTION

PATENT NO. : 4,660,920

DATED : April 28, 1987

INVENTOR(S) : Yasuji Shibano

It is certified that error appears in the above-identified patent and that said Letters Patent is hereby corrected as shown below:

Claim 20, column 10, line 1, "staped" should be --stamped--.

Signed and Sealed this

Twenty-sixth Day of April, 1988

*Attest:*

DONALD J. QUIGG

*Attesting Officer*

*Commissioner of Patents and Trademarks*